US006927755B2

(12) United States Patent
Chang

(10) Patent No.: US 6,927,755 B2
(45) Date of Patent: Aug. 9, 2005

(54) DEVICE FOR ELIMINATING THE FLICKERING PHENOMENON OF TFT-LCD

(75) Inventor: Yung Yi Chang, Hualien (TW)

(73) Assignee: Unipac Optoelectronics Corporation, Hsin-Chu (TW)

( * ) Notice: Subject to any disclaimer, the term of this patent is extended or adjusted under 35 U.S.C. 154(b) by 488 days.

(21) Appl. No.: 09/907,250

(22) Filed: Jul. 17, 2001

(65) Prior Publication Data

US 2002/0109657 A1 Aug. 15, 2002

(30) Foreign Application Priority Data

Feb. 15, 2001 (TW) ..... 90103390 A

(51) Int. Cl.[7] ..... G09G 3/36

(52) U.S. Cl. ..... 345/101; 345/92; 345/204; 349/39

(58) Field of Search ..... 345/87–90, 91–101, 345/204, 55; 349/39, 92–96

(56) References Cited

U.S. PATENT DOCUMENTS 5,253,091 A * 10/1993 Kimura et al. ..... 345/94
5,436,747 A * 7/1995 Suzuki ..... 349/42
5,926,162 A * 7/1999 Wood et al. ..... 345/101
6,005,541 A * 12/1999 Takahashi et al. ..... 345/87
6,166,726 A * 12/2000 Uchida et al. ..... 345/211
6,278,426 B1 * 8/2001 Akiyama ..... 345/87
6,329,976 B1 * 12/2001 Johnson et al. ..... 345/101
6,590,555 B2 * 7/2003 Su et al. ..... 345/92

FOREIGN PATENT DOCUMENTS

JP 11-281957 10/1999

* cited by examiner

*Primary Examiner*—Alexander Eisen
*Assistant Examiner*—Kimnhung Nguyen
(74) *Attorney, Agent, or Firm*—Ladas & Parry LLP

(57) ABSTRACT

A device to minimize the flickering phenomenon of thin-film-transistor liquid-crystal-display (TFT-LCD), and prevent the discharge insufficiency problem when the TFT operates under low temperature. The device primarily uses temperature compensation components or circuits to achieve a $V_{GH}$ curve corresponding to the temperature characteristics of the TFT. The gate pulse is slashed more substantially at high temperature and less at low temperature so that the recharging problem at low temperature is solved.

13 Claims, 5 Drawing Sheets

DEVICE FOR ELIMINATING THE FLICKERING PHENOMENON OF TFT-LCD

BACKGROUND OF THE INVENTION

1. Field of the Invention

The present invention relates in general to a thin-film-transistor liquid-crystal-display(TFT-LCD). In particular, the present invention relates to a flicker-proof thin-film-transistor liquid-crystal-display.

2. Description of the Related Art

The structure of a conventional TFT-LCD is comprised essentially of LCD cells comprising a pair of electrode substrates filled with liquid crystal molecules. Polarizors are adhered to the sides of the electrode substrates. Signal lines and scanning lines are formed perpendicularly with each other forming a matrix on one of the substrates. The scanning lines are connected to each gate of the TFT controlling the on/off state of the TFT and hence the writing of video signals.

Referring to FIGS. 1A and 1B, a pulse signal at the front of the signal scanning line is shown in FIG. 1A. Because of the parasitic resistors and capacitors on the scanning line, the input pulse signal is subjected to RC (time constant) delay. Therefore at the end of the scanning line, the pulse wave is transformed to that shown in FIG. 1B. A voltage coupled from the gate of the TFT is defined as follows:

$$V_{COUPLED}=V_G\times C_{gs}/(C_{gs}+C_{LC}+C_{ST})$$

where $V_G$ is the voltage applied to the gate, $C_{gs}$ is the capacitance between the gate and the source, $C_{LC}$ is the capacitance of the liquid crystals, and $C_{ST}$ is the capacitance of a storage capacitor.

The voltage applied to the gate of the TFT at the front end of the scanning line is $V_{G1}$, and the voltage applied to the gate of the TFT at the rear end of the scanning line is $V_{G2}$. In the conventional art, because $V_{G1}$ is greater than $V_{G2}$, the coupled voltage $V_{COUPLED1}$ is greater than $V_{COUPLED2}$. As a result, the LCD display may flicker.

In order to solve the problem of flickering, Japanese Patent Application Laid-Open No. 11-281957 (Sharp Corporation) reduces the gate voltage. That is, the circuit in FIG. 2 is adopted to provide the $V_{VH}$ in FIG. 3 for the driving circuit of the gate of the TFT and the pulse wave generated is as shown in FIGS. 4A and 4B. Referring to FIG. 3, $S_{tc}$ is a trigger voltage for controlling switches SW1 and SW2 such that the circuit is discharged when SW1 is off and SW2 is on resulting in drop of $V_{GH}$; and the circuit is connected to the power supply $V_{dd}$ and recharged when SW1 is on and SW2 is off to allow $V_{GH}$ to climb back. Additionally, FIG. 3 shows curve A representing the voltage signal $V_{GH}$ at a lower temperature and curve B representing the voltage signal $V_{VH}$ at a higher temperature.

In FIGS. 4A and 4B, the front end of the gate pulse input to the scanning line is slashed so that the gate voltage $V_{G1}$ of the input pulse is approximately equal to the gate voltage $V_2$ of the pulse transmitted to the end of the scanning line. Hence the coupled voltage $V_{COUPLED1}$ is approximately equal to $V_{COUPLED2}$ to avoid the flicker phenomenon.

Transistor is usually used as a switch as shown in the circuit in FIG. 2. Normally, TFT needs a longer period to be recharged when the temperatures is low dues the inferior mobility of the carriers. Nonetheless, the temperature characteristic of Transistor slashes the gate pulse more at lower temperatures. The slashes on the gate pulses reduce the recharging time of the TFT. Consequently, insufficient recharging time of TFT occurs at lower temperatures.

SUMMARY OF THE INVENTION

An object of the present invention is to provide a device minimizing the flickering phenomenon of a thin-film-transistor liquid-crystal-display (TFT-LCD), and avoiding the recharge problem when the TFT operates under low temperature.

To achieve the object of the present invention, a flicker-proof device for a TFT-LCD provided using temperature compensating components or circuits to achieve a $V_{GH}$ curve corresponding to the temperature characteristics of the TFT. In other words, the gate pulse is slashed more substantially at high temperature and less at low temperature so that the recharging problem at low temperature is solved.

BRIEF DESCRIPTION OF THE DRAWINGS

The present invention can be more fully understood by reading the subsequent detailed description in conjunction with the examples and references made to the accompanying drawings, wherein.

DETAILED DESCRIPTION OF THE PREFERRED EMBODIMENT

Figure 1A:
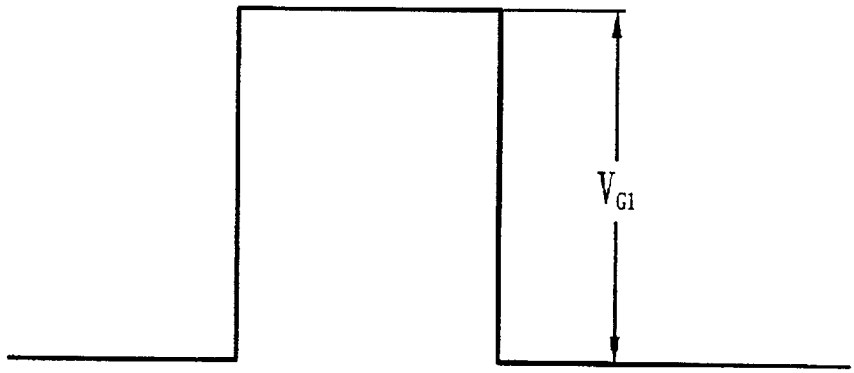
FIG. 1A (PRIOR ART)
FIG. 1A shows a pulse signal at the front of the signal scanning line.
Figure 1B:
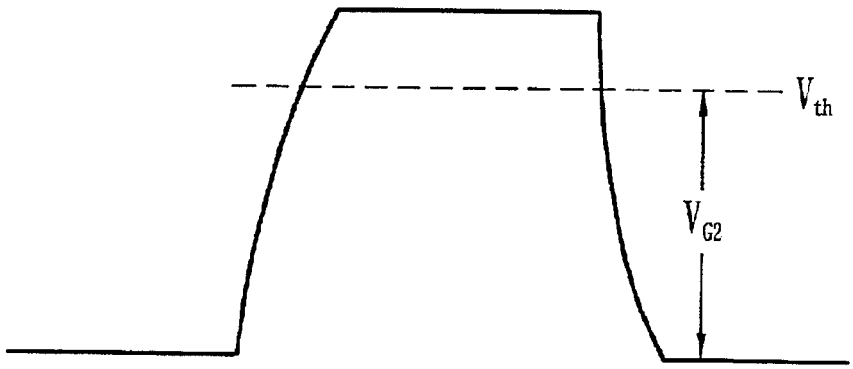
FIG. 1B (PRIOR ART)
FIG. 1B shows the transformed pulse wave at the end of the scanning line.
Figure 2:
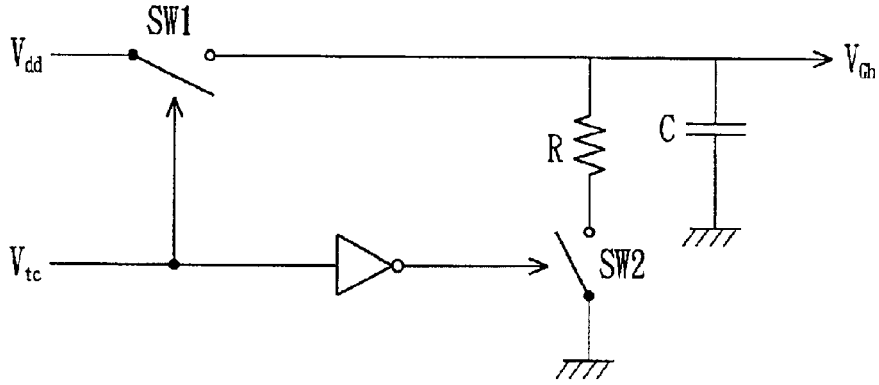
FIG. 2 (PRIOR ART)
FIG. 2 shows a pulse signal at the end of the signal scanning line.
Figure 3:
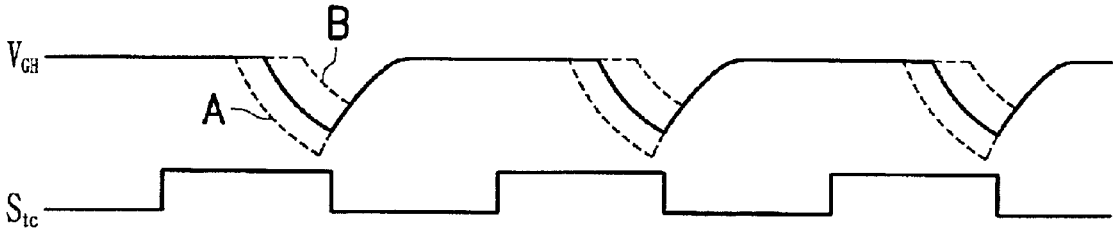
FIG. 3 (PRIOR ART)
FIG. 3 shows the I/O signal waveform of the circuit in FIG. 2.
Figure 4A:
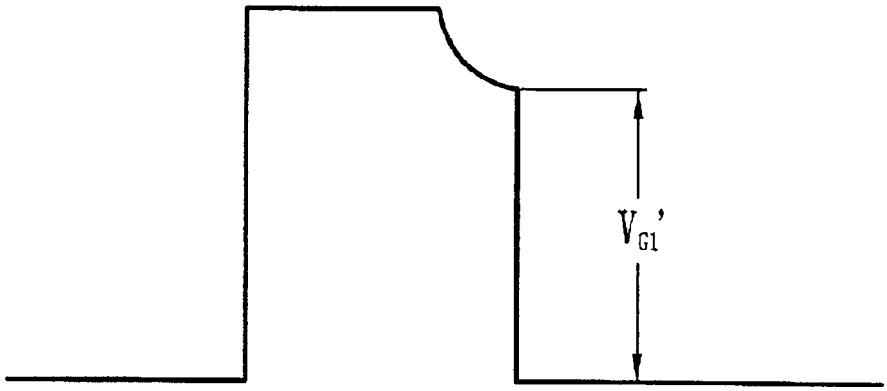
FIG. 4A (PRIOR ART)
FIGS. 4A and 4B show the pulse wave provided to the gate of the TFT on the scanning electrode by the circuit in FIG. 2.
Figure 4B:
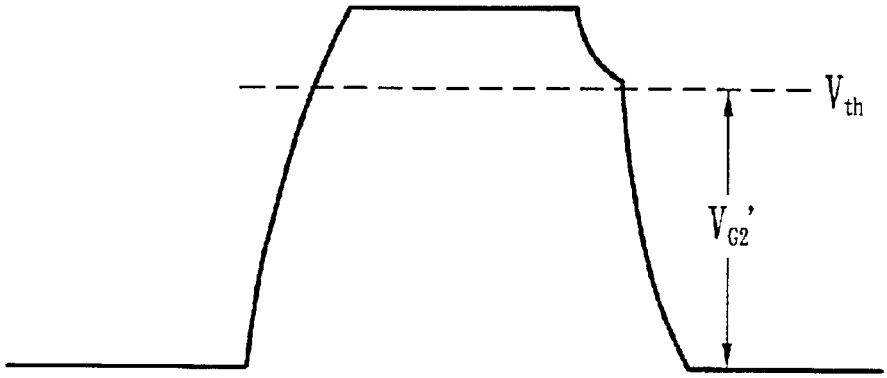
FIG. 4B (PRIOR ART)
Figure 5:
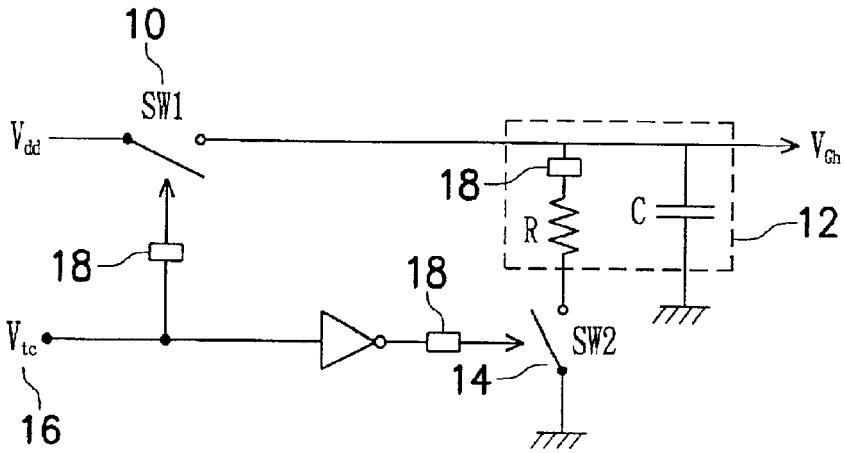
FIG. 5 shows the circuit of the device used in the embodiment of the present invention to eliminate the flickering of the TFT-LCD.

Referring to FIG. 5, the device of the present invention for eliminating the flicker phenomenon of a thin-film-transistor liquid-crystal-display (TFT-LCD) comprises: a first switch SW1 10, a discharge circuit 12, a second switch SW2 14, a trigger signal source 16, and a plurality of compensators 18. The first switch SW1 10 is configured between a power supply and the output end of the device. The discharge circuit 12 is connected between the first switch SW1 10 and the output end of the device at one end and is connected to the other ground at the other end. The second switch SW2 14 is used for controlling whether the discharge circuit is grounded. The trigger signal source 16 is used for controlling the switches SW1 and SW2. When the first switch SW1 10 is on and the second switch SW2 14 is off, the output end of the device is connected to the power supply Vdd and the circuit is recharged. When the first switch SW1 10 is off and the second switch SW2 14 is on, the discharge circuit 12 is grounded and discharged. The temperature compensators 18 can be located between the trigger signal source 16 and the first switch SW1 10, the trigger signal source 16 and the second switch SW2 14, or anywhere in the discharge circuit 12 to equalize the voltage float at the output end of the device to the temperature characteristic of the TFT such that the circuit recharge or discharge rate is slower at lower temperatures and faster at higher temperatures.

Figure 6:
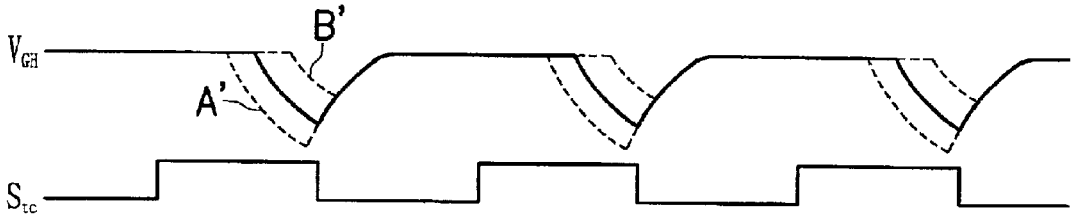
FIG. 6 is the I/O waveform generated by the circuit in FIG. 5.

FIG. 6 shows the voltage signal $V_{GH}$ generated by the power supply described above. Curve A' represents the pulse wave of $V_{GH}$ at a higher temperature, curve B' shows the pulse wave of $V_{GH}$ at a lower temperature.

Figure 7:
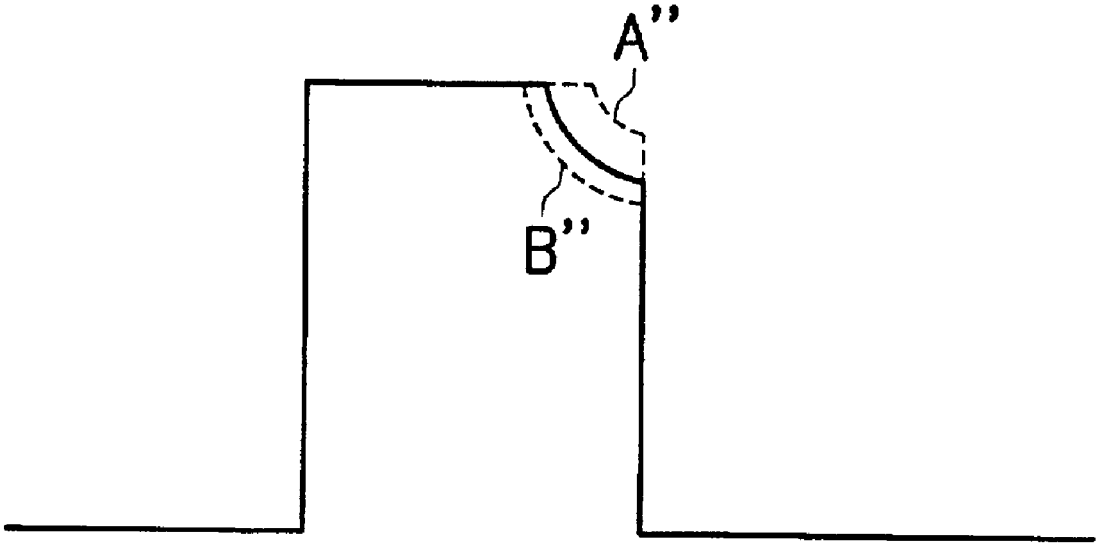
FIG. 7 shows the pulse signal provided to the gate of the TFT of the scanning line according to an embodiment of the present invention.

The voltage signal $V_{GH}$ is sent to the driver of the gate of the TFT and output as the gate pulse shown in FIG. 7. As shown in the FIG. 7, curve A" is the gate pulse at a lower temperature. Being slashed less, it provides a longer recharging period for the TFT. Curve B" is the gate pulse at a higher temperature. It is slashed more substantially to provide a shorter recharging period for the TFT.

The first and the second switches 10 and 14 can be transistors and are controlled by the trigger signal 16. The discharge circuit 12 comprises a resistor R and a capacitor C connected in parallel, wherein the resistor R is grounded via the second switch SW2.

The temperature compensator 18 can be a component, such as a transistor with certain temperature characteristics or a thermistor, or a temperature-compensation circuit such as a diode circuit. The temperature compensator of the present invention has a negative temperature coefficient. Taking the thermistor for example, the resistance becomes smaller when the temperature becomes larger. Conversely, the resistance becomes larger when the temperature decreases. When the temperature becomes lower and the resistance increases, the RC constant in the discharge circuit 12 increases. As a result, the discharge rate becomes slower, and the pulse wave provided to the TFT is slashed less, leaving a longer recharging period for the TFT. In other words, the image signals on the signal lines have more time to be written into the liquid crystal capacitors and the storage capacitors at the lower temperature.

Accordingly, the present invention uses devices with temperature-compensation characteristics to make the gate pulse wave suffer less from the slash impact at low temperature and more at high temperature. Thereby, the length of the TFT conductive time to meet the recharging requirements at different temperatures can be controlled. The temperature-compensation device can be components or circuits with negative temperature coefficient.

While the present invention has been particularly shown and described with reference to a preferred embodiment, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A device for eliminating the flickering of thin-film-transistor liquid-crystal-display (TFT-LCD), the device comprises:

a first switch, configured between a power supply and an output end of the device;

a discharge circuit, with one end connected between the first switch and the output end of the device and the other end connected to the ground;

a second switch, for controlling whether the discharge circuit is grounded;

a trigger signal source, for controlling the switches; wherein when the first switch is on and the second switch is off, the output end of the device is connected to the power supply and the circuit is recharged, and when the first switch is off and the second switch is on, the discharge circuit is grounded and discharged; and means for delaying opening of the second switch at lower temperatures, wherein the means is a component or circuit with negative temperature coefficient.

2. The device in claim 1, wherein the first and the second switches are transistors.

3. The device in claim 1, wherein the discharge circuit comprises a resistor and a capacitor.

4. A device for eliminating the flickering of thin-film-transistor liquid-crystal-display (TFT-LCD), comprising:

a first switch, configured between a power supply and an output end of the device;

a discharge circuit, with one end connected between the first switch and the output end of the device and the other end connected to the ground;

a second switch, for controlling discharge circuit grounding;

a trigger signal source, for controlling the switches; wherein when the first switch is on and the second switch is off, the output end of the device is connected to the power supply and the circuit is recharged, and when the first switch is off and the second switch is on, the discharge circuit is grounded and discharged; and means for delaying opening of the second switch at lower temperatures, the means disposed in the discharge circuit.

5. The device in claim 1, wherein the means for delaying opening of the second switch is configured between the trigger signal source and the second switch.

6. The device in claim 1, wherein the means for delaying opening of the second switch is a thermistor.

7. The device in claim 1, wherein the means for delaying opening of the second switch has higher resistance at low temperature and lower resistance at high temperature.

8. A device for eliminating the flickering of thin-film-transistor liquid-crystal-display (TFT-LCD), the comprising:

a first transistor, for connecting a power supply and an output end of the device;

a discharge circuit, with one end connected between the first transistor and the output end of the device and the other end connected to the ground;

a second transistor, for controlling whether the discharge circuit is grounded;

a trigger signal source, for controlling the transistors; wherein when the first transistor is on and the second transistor is off, the output end of the device is connected to the power supply and the circuit is recharged, and when the first transistor is off and the second transistor is on, the discharge circuit is grounded and discharged; and a thermistor for delaying opening of the second transistor at lower temperatures.

9. The device in claim 8, wherein the discharge circuit comprises a resistor and a capacitor.

10. The device in claim 8, wherein the means for delaying opening of the second transistor is disposed in the discharge circuit.

11. The device in claim 8, wherein the means for delaying opening of the second transistor is configured between the trigger signal source and the first transistor.

12. The device in claim 8, wherein the means for delaying opening of the second transistor is configured between the trigger signal source and the second transistor.

13. A device for eliminating the flickering of thin-film-transistor liquid-crystal-display (TFT-LCD), the device comprising:

a first switch, configured between a power supply and an output end of the device;

a discharge circuit, with one end connected between the first switch and the output end of the device and the other end connected to the ground;

a second switch, for controlling whether the discharge circuit is grounded;

a trigger signal source, for controlling the switches; wherein when the first switch is on and the second switch is off, the output end of the device is connected to the power supply and the circuit is recharged, and when the first switch is off and the second switch is on, the discharge circuit is grounded and discharged; and means for delaying opening of the second switch at lower temperatures, wherein the means for delaying opening of the second switch is configured between the trigger signal source and the second switch.

* * * * *

UNITED STATES PATENT AND TRADEMARK OFFICE

CERTIFICATE OF CORRECTION

PATENT NO. : 6,927,755 B2
DATED : August 9, 2005
INVENTOR(S) : Yung Yi Chang

It is certified that error appears in the above-identified patent and that said Letters Patent is hereby corrected as shown below:

Title page,
Item [73], Assignee, change "Unipac Optoelectronics Corporation, Hsin-Chu (TW)" to -- AU Optronics Corp., Hsinchu (TW) --.

Signed and Sealed this

Thirteenth Day of September, 2005

JON W. DUDAS
*Director of the United States Patent and Trademark Office*